US008670870B1

(12) United States Patent
Bush, Jr. et al.

(10) Patent No.: US 8,670,870 B1
(45) Date of Patent: Mar. 11, 2014

(54) MODULAR HVAC SYSTEM FOR PROVIDING POSITIVE PRESSURE TO AN INTERIOR OF A POSITIVE PRESSURE FACILITY

(75) Inventors: Ronald M. Bush, Jr., Houston, TX (US); James Penrod, Houston, TX (US); William Riter, Houston, TX (US); Kyle Cook, Houston, TX (US); Carl Gosnell, Houston, TX (US)

(73) Assignee: Englobal Corporation, Houston, TX (US)

( * ) Notice: Subject to any disclaimer, the term of this patent is extended or adjusted under 35 U.S.C. 154(b) by 367 days.

(21) Appl. No.: 13/236,375

(22) Filed: Sep. 19, 2011

(51) Int. Cl.
*G06F 19/00* (2011.01)

(52) U.S. Cl.
USPC ..... 700/276; 702/31; 702/33; 261/128; 236/49.3; 73/863.02; 62/157; 62/404

(58) Field of Classification Search
USPC ..... 700/276; 702/31, 33; 261/128; 236/49.3; 73/863.02; 62/157, 404
See application file for complete search history.

(56) References Cited

U.S. PATENT DOCUMENTS

| | | | | |
|---|---|---|---|---|
| 7,484,668 | B1 * | 2/2009 | Eiler | 236/49.3 |
| 7,765,072 | B2 * | 7/2010 | Eiler et al. | 702/31 |
| 2004/0187517 | A1 * | 9/2004 | Solomon | 62/404 |
| 2007/0056299 | A1 * | 3/2007 | Shankweiler | 62/157 |
| 2008/0015794 | A1 * | 1/2008 | Eiler et al. | 702/33 |
| 2012/0325023 | A1 * | 12/2012 | Calio et al. | 73/863.02 |
| 2013/0106004 | A1 * | 5/2013 | Stumphauzer | 261/128 |

* cited by examiner

*Primary Examiner* — Kavita Padmanabhan
*Assistant Examiner* — Douglas Lee
(74) *Attorney, Agent, or Firm* — Buskop Law Group, PC; Wendy Buskop

(57) ABSTRACT

A system for providing positive pressure to an interior of a positive pressure facility can include an enclosure for securing to an exterior of the positive pressure facility, an evaporator motor compartment with a motor, a compressor compartment with a compressor, a fresh air intake section for bringing air in from outside, a condenser compartment with air venture, a heater compartment with a heater, and an enclosure extension for attaching to the interior of the positive pressure facility. An electrical compartment can be connected with a return air compartment of the enclosure extension. A human machine interface with a display can present controls for controlling the system and various portions of real-time information related to the system.

20 Claims, 14 Drawing Sheets

6
89
10
142a
142b
94
92
7
90
8
16
18
21
24
25
14

8
9
10
12
104
102a
98a
105
99
100
140
98f
96
102f
48
38
110
106
108
40
42
46
50
116
107
52
54
56
114
112

MODULAR HVAC SYSTEM FOR PROVIDING POSITIVE PRESSURE TO AN INTERIOR OF A POSITIVE PRESSURE FACILITY

FIELD

The present embodiments generally relate to a modular heating, ventilation, and air conditioning (HVAC) system for providing positive pressure to an interior of a positive pressure facility.

BACKGROUND

A need exists for a prefabricated HVAC system that can provide a pressure differential between an interior of a building and an exterior of a building, such as a portable building.

A need exists for an HVAC system with a high reliability and ease of maintenance that provides warnings through a human machine interface.

A further need exists for an easy to use and easy to install HVAC system.

The present embodiments meet these needs.

BRIEF DESCRIPTION OF THE DRAWINGS

The detailed description will be better understood in conjunction with the accompanying drawings as follows.

Figure 1:
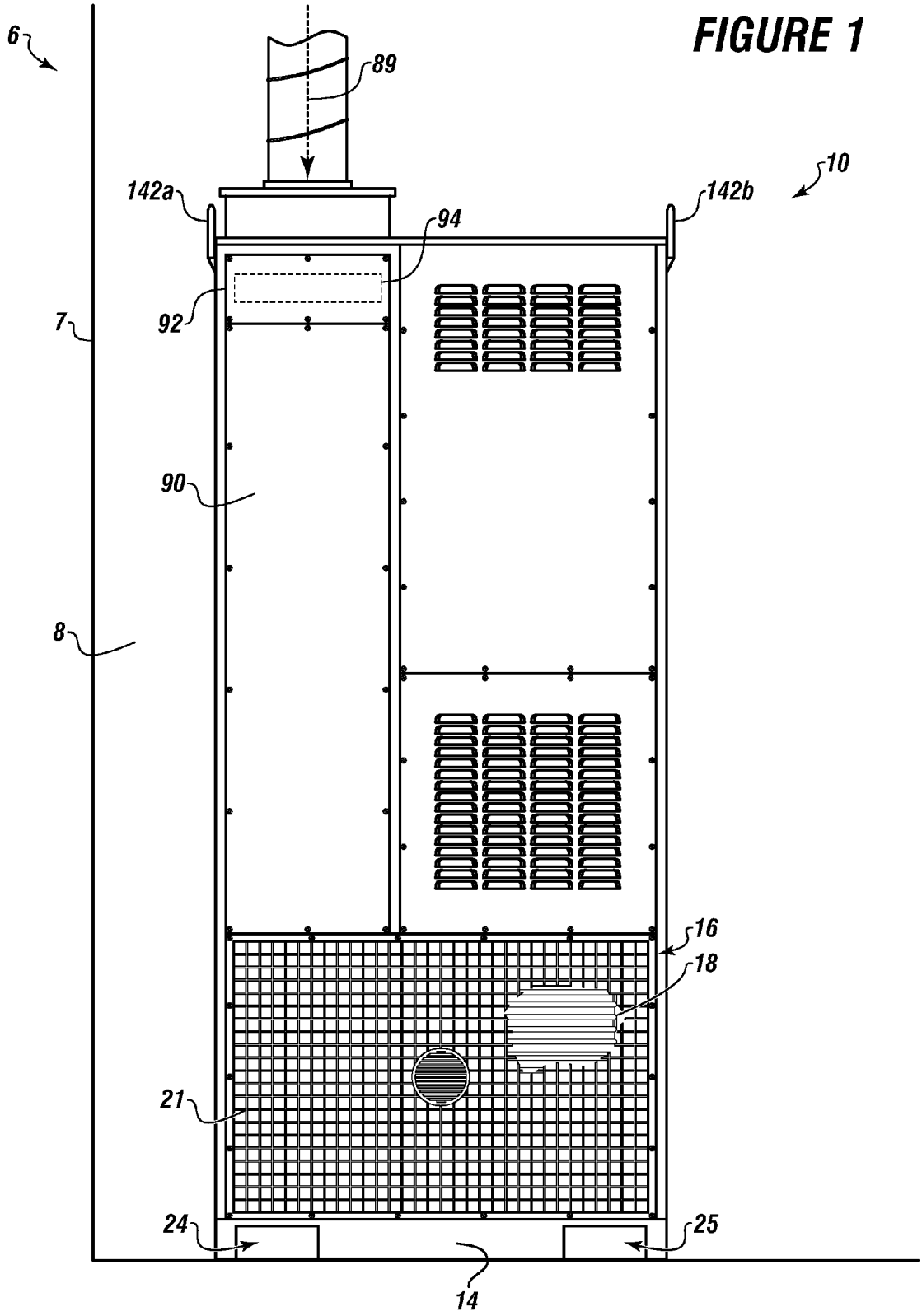
FIG. 1 depicts an installed HVAC system on a positive pressure facility.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments relate to a modular HVAC system for providing positive pressure to an interior of a positive pressure facility.

The positive pressure provided can range from about 0.05 water column inches to about 0.25 water column inches, and can be less than or greater than an air pressure surrounding the building of the positive pressure facility.

The HVAC system can include an enclosure, which can be made of metal. The enclosure can be secured to an exterior of the positive pressure facility.

The enclosure can have a base, which can have two openings. The two openings of the base can allow prongs of a forklift to engage with the base to move the enclosure.

The enclosure can have lifting eyes for lifting the enclosure as a one piece unit with a crane.

A condenser compartment can be disposed within the enclosure. The condenser compartment can be mounted to the base. The condenser compartment can be a metal frame, such as an aluminum frame.

The condenser compartment can contain an air inlet for receiving surrounding air.

An air inlet grill can be disposed over the air inlet. The air inlet grill can be a frame with metal slats to allow the surrounding air to flow into the air inlet.

A condenser coil can be disposed in the condenser compartment. For example, the condenser coil can be one manufactured by Heat Craft of Grenada Miss.

An air venturi can be mounted to the condenser coil. The air venture can be used to pull the surrounding air through the air inlet grill, which can cover a side of the condenser compartment.

The air venturi can function to pull the air across the entire condenser coil, rather than just along the direction of flow from fans within the condenser compartment.

By pulling the surrounding air into the condenser compartment using the venturi effect and fans, rather than pushing the surrounding air, energy can be saved and more cooling can be provided due to a lower coefficient of friction.

Also, pulling the surrounding air from the outside to the inside allows the build-up of dirt and other foreign objects from the surrounding air to be visible on the outside of the HVAC system. As such, the HVAC system can be more easily visually inspected without having to dismantle portions of the HVAC system to inspect the interior portions.

A condenser motor can be disposed in the condenser compartment. The condenser motor can be connected with a wall, such as a front wall, of the condenser compartment. The condenser motor can be a 0.5 to 3 HP motor, such as one made by WEG Electric Corp. of Duluth Ga.

A condenser motor bracket can support the condenser motor in the enclosure.

One fan can be mounted to each condenser motor. The fan with fan blades can operate in conjunction with the air venturi to pull the surrounding air into the condenser compartment.

An evaporator motor compartment can be connected adjacent the condenser compartment.

The evaporator motor compartment can contain at least one evaporator motor.

In one or more embodiments, two or more evaporator motors can be mounted in the evaporator motor compartment. Each evaporator motor can be connected with a power supply, which can be disposed outside of the evaporator motor compartment.

Each evaporator motor can be a 0.5 HP motor to 3 HP motor, such as one made by WEG Electric Corporation. Each evaporator motor can run on an A/C current.

An evaporator compartment can be mounted to the evaporator motor compartment.

The evaporator compartment can have at least one evaporator fan for each evaporator motor. For example, if the HVAC system includes two evaporator motors, the HVAC system can include two evaporator fans.

Examples of evaporator fans usable in the HVAC system include a tri-blade aluminum fan made by Lau of Dayton, Ohio.

An evaporator coil can be mounted in the evaporator compartment for receiving a refrigerant and cooling fresh air from the fresh air inlet section, thereby forming conditioned air.

The HVAC system can include evaporator coils, such as those available from Luvata of Wayzata, Minn.

The evaporator coils, evaporator fans, and evaporator motors can all be connected with a process control unit and a human machine interface, which can be mounted to a side of the HVAC enclosure.

The condenser coil, fan blades, and condenser motor can all be connected with the process control unit and human machine interface.

A refrigerant liquid line can connect to each evaporator coil. Refrigerant within the refrigerant liquid line can be R-134A. The refrigerant can be maintained at a pressure of about 280 pounds per square inch gauge (psig) within the refrigerant liquid line.

A refrigerant suction line can be connected with the evaporator coil. The temperatures of the refrigerant liquid line and the refrigerant suction line can range from about 40 degrees Fahrenheit to about 120 degrees Fahrenheit.

A thermostatic expansion valve can be in the evaporator compartment, such as one made by Parker of Cleveland, Ohio. The thermostatic expansion valve can be connected with the refrigerant liquid line.

The evaporator compartment can have evaporator compartment insulation attached to inner walls of the evaporator compartment.

In operation, a condensate can be produced on the refrigerant liquid line, and can enter the evaporator compartment. The evaporator compartment can have an evaporator compartment drain to allow that condensate to exit the evaporator compartment. The condensate can be water.

The evaporator compartment and the evaporator motor compartment can be framed shells, which can be made of sheet metal.

A compressor compartment can be disposed adjacent the evaporator motor compartment.

The compressor compartment can have a compressor, such as a model ZR40K3E-TFD-230 made by Copeland.

The compressor can be mounted on a stand or mounted directly to walls of the compressor compartment and connected between the refrigerant suction line and a refrigerant discharge line.

A compressor mount can be used in the compressor compartment to support the compressor.

The compressor compartment can also have a compressor heater electrically connected with the compressor.

A high pressure transducer for sensing temperature can be connected with the refrigerant discharge line and to the process control unit and human machine interface.

The compressor and the compressor heater can be connected with the process control unit and human machine interface to provide centralized control of all the components of the HVAC system.

In addition to the high pressure transducer, a low pressure transducer can be connected with the refrigerant suction line.

The low pressure transducer and the high pressure transducer can be ones available from Johnson Supply of Austin, Tex. The low pressure transducer and the high pressure transducer can be connected with the process control unit and human machine interface.

The compressor compartment can include a shut off valve, which can be connected with the refrigerant discharge line. Additionally, a hot gas bypass valve can be connected with the shut off valve. The shut off valve and hot gas bypass valves can be those made by Parker, for example.

A refrigerant site glass can be connected with the refrigerant liquid line. The refrigerant site glass can be made by Parker, such as model SA-14S.

A refrigerant liquid line dryer can be fluidly connected with the refrigerant site glass.

The refrigerant liquid line dryer can be one available from Parker, such as model C-164-S.

A refrigerant shut off valve can be connected with the refrigerant liquid line dryer.

The fresh air intake section can be disposed in the enclosure to bring fresh air from outside the enclosure into the evaporator compartment.

A filter holder can support an air filter over the fresh air intake section.

In one or more embodiments, the enclosure can include a heater compartment adjacent the compressor compartment.

The heater compartment can have at least two fin heaters connected with the power supply. The fin heaters can be 1-2 kilowatt heaters, such as those available from Tamman of Taiwan, and can operate on A/C current.

A conditioned air grill can be positioned to separate the heater compartment from the interior of the positive pressure facility.

A conditioned air temperature sensor can be mounted in the heater compartment for monitoring the temperature of conditioned air. The conditioned air temperature sensor can be one available from Watlow of St. Louis, Mo. The conditioned air temperature sensor can be in communication with the process control unit and the human machine interface.

The heater compartment can include a plurality of resistive temperature detectors. Each resistive temperature detector can be connected with and monitor a temperature of one of the fin heaters, and can be in communication with the process control unit and the human machine interface.

The heater compartment can include heater compartment insulation. The heater compartment insulation can be mounted within the heater compartment to prevent sweating. The heater compartment insulation can be a closed cell neoprene.

The HVAC system can include an enclosure extension for attaching to the interior of the positive pressure facility and to the enclosure. The enclosure extension can protrude through the exterior to the interior of the positive pressure facility.

The enclosure extension can include a return air compartment. The return air compartment can have a return air grill, which can be made of plastic or metal, such as anodized aluminum.

The return air compartment can have a return air filter. The return air filter can be made of a pleated washable paper filter, cellulose, or another material.

The return air compartment can have a plurality of opposed blade dampers, such as from one blade damper pair to about fifty blade damper pairs.

The return air compartment can have a humidistat. The humidistat can detect humidity in percent of humidity ranging from about 0 percent to about 100 percent humidity.

The return air compartment can include a return air resistive temperature detector, which can be connected with the process control unit and the human machine interface.

The enclosure extension can include an electrical compartment connected with the return air compartment.

The electrical compartment can have electrical compartment insulation, which can be closed cell neoprene mounted within the electrical compartment.

The electrical compartment can have an electrical control box, such as a model ACSEW 091504 available from Appleton of Rosemont, Ill., for receiving power from the power supply.

The electrical control box can include a relay, such as one from ABB of Houston, Tex., for each of the evaporator motor, condenser motor, and compressor.

The electrical control box can include a connector, such as one from ABB, for each evaporator motor, condenser motor, and compressor.

The electrical control box can include an overload protection circuit, such as one from ABB, for each evaporator motor, and condenser motor.

The electrical compartment can have an electrical control box with a back panel to which each relay, connector, and overload protection circuit can be mounted.

The electrical control box can have a plurality of explosion resistant seals disposed around conduits that pass from an outside surface of the electrical control box to inside the electrical control box.

The electrical compartment can have control wiring to control power flow through the electrical control box, a control power transformer connected with the control wiring, a D/C power supply connected with the control power transformer, and control power fuses connected with control power transformer.

In one or more embodiments, an evaporator flexible electrical conduit can convey power through a junction box from the power supply to the evaporator motor.

A condenser flexible electrical conduit can be used to convey power through the junction box from the power supply to the condenser.

A compressor flexible electrical conduit can be used to convey power through the junction box from the power source to the compressor and compressor heater.

The process control unit can be connected with the electrical control box to control electrical flow through the electrical compartment. The process control unit can be an IDEC programmable logic controller (PLC) for example, a model FC5A.

In one or more embodiments, the enclosure extension can include the human machine interface (HMI).

The human machine interface can have a pressure transducer for determining differential pressure between a pressure outside the positive pressure facility to the pressure interior of the positive pressure facility.

The pressure transducer can be connected with the process control unit. The pressure transducer can be one available from Dwyer of Michigan City, Ind., such as model 668-1.

The human machine interface can provide real-time temperature values. The real-time temperature values can include a temperature for the return air, fin heaters, conditioned air, refrigerant discharge line, refrigerant liquid line, and refrigerant suction line, as well as other portions of the HVAC system.

The human machine interface can provide real-time humidity values, such as a humidity level of the return air.

The human machine interface can provide real-time building pressure of the building.

The human machine interface can provide a home control button, which can be initiated by a user to present a home display screen on the display of the human machine interface.

The human machine interface can provide a control button, which can be initiated by a user to present a control screen on the display of the human machine interface.

The human machine interface can provide a health control button, which can be initiated by a user to present a health screen on the display of the human machine interface.

The human machine interface can provide a set points control button, which can be initiated by a user to present a set points screen on the display of the human machine interface.

The human machine interface can provide a values control button, which can be initiated by a user to present a real-time values screen on the display of the human machine interface.

The human machine interface can provide a heating, cooling, and dehumidifying indicator, which can indicate that the HVAC system is heating, cooling, dehumidifying, or combinations thereof. For example, the heating, cooling, and dehumidifying indicator can be the color blue to represent cooling.

The human machine interface can provide an operating indicator, which can be the color green. The operating indicator can be an online indication that the process control unit is operating. A different color can be used to indicate the unit is off.

The human machine interface can provide a building pressure OK indicator, which can be the color green. The building pressure OK indicator can indicate that the building pressure is within the defined set points. Red could be used if the building pressure is outside the set points.

The human machine interface can provide a system OK alarm, which can indicate that the system is operating properly and can be colored green. The color red could be used to indicate that the system is not operating properly.

The human machine interface can provide a time, which can include a day of week indication, a month, a day of month, a year indicator, and a time of day.

A health screen can be formed using computer instructions in the process control unit linked to the health control button. For example, when a user initiates the health control button the health screen can be presented on a display of the human machine interface.

The health screen can present real-time health information. The real-time health information can be updated in various intervals, such as in one to five second intervals.

The real-time health information can include a rotation OK, indicating a status of the input power phasing to the system.

The real time health information can include a fire smoke OK, indicating an alarm of the fire or smoke system.

The real time health information can include a gas detection OK, indicating an alarm of the gas detection system in the positive pressure facility.

The real time health information can include a 100 percent recirculate off, indicating the HVAC system is pulling at least a portion of fresh air into the system.

The real time health information can include a condensate level OK, indicating condensate is not in the condensate drain pan.

The real-time health information can include a low building temperature OK, indicating whether or not the temperature of the building is above a low temperature set point.

The real time health information can include an indication of high building temperature within first building set point, indicating the building temperature is below a building temperature high set point.

The real time health information can include a high building temperature within second building set point, indicating the building temperature below a second building temperature high set point.

The real time health information can indicate a building pressure OK is above a building pressure set point.

The real-time health information can include a humidity OK, indicating that the humidity level of the return air is below a set point.

The real time health information can include a communication OK, indicating portions of the HVAC system are communicating to another HVAC system.

The real time health information can include a redundancy OK indication, which indicates that two or more connected HVAC systems do not have any alarms.

The real-time health information can include a stage 1 low refrigerant pressure alarm and a stage 1 high refrigerant pressure alarm.

The stage 1 low pressure alarm means a low refrigerant level exists.

The stage 1 high pressure alarm means a high refrigerant level exists.

The real-time health information can include a stage 1 #1 heater high temperature OK, which indicates that heater 1 is within a set point range.

The real-time health information can include a stage 1 #2 heater high temperature OK, which indicates that heater 2 is within a set point range.

The real-time health information can include a stage 1 #3 heater high temperature OK, which indicates that heater 3 is within a set point range.

The real-time health information can include a stage 2 #1 heater high temperature OK, which indicates that heat 1 is within a set point range.

The real-time health information can include a stage 2 #2 heater high temperature OK, which indicates that heater 2 is within a set point range.

The real-time health information can include a stage 2 #3 heater high temperature OK, which indicates that heater 3 is within a set point range.

The real-time health information can include a compressor malfunction alarm, indicating that whether or not the compressor has malfunctioned.

The real-time health information can include a compressor amps OK, a condenser amps OK, an evaporator #1 amps OK, and an evaporator #2 amps OK, indicating that amperage being used by the compressor and evaporator motors are within set points.

The health screen can also present the home control button, control button, health control button, set points control button, values control button, the heating, cooling, and dehumidifying indicator, operating indicator, building pressure OK indicator, system OK alarm.

Computer instructions in the process control unit can be linked to the control button for presenting on the display real-time control information, which can be updated in one to five second intervals. When the control button is initiated, the process control unit and human machine interface can present a control screen on the display.

The real-time control information can include: a first step button for changing a status of the HVAC system from off, to auto, to on; a second step button for changing the status of the modular heating, ventilation, and air conditioning system from on, to auto, to off; the real-time temperature values; real-time humidity values; real-time building pressure; home control button; control button; health control button; the points control button; values control button; and heating, cooling, and dehumidifying indicator.

The control screen can also present: the operating indicator, the building pressure OK indicator, and the system OK alarm.

The HVAC system can include computer instructions for providing real-time set points information.

The computer instructions, which can be in the process control unit, can be linked to the set points control button for presenting on the display real-time set points information.

The real-time set points information can be updated in one to five second intervals. When a user initiates the set points control button, the human machine interface can present the real-time set points information.

The real-time set points information can be log-in information, alarm history information, temperature set points for the positive pressure facility, and humidity set points for the positive pressure facility.

The real-time set points information can include low building temperature set points, high building temperature set points, high humidity set points, low pressure alarm delay intervals caused when personnel enter or leave the positive pressure facility, an update all HVAC button that synchronizes all of the HVAC updates with a single stroke for a given set point.

The set points screen can present the home control button, control button, health control button, set points control button, and values control button.

The HVAC system can include computer instructions in the process control unit to present instructions for a user to enter a password, cancel, clear, and enter new values in the process control unit.

The HVAC system can include computer instructions in the process control unit to provide to the display a plurality of preset values and a meter button in real-time. The plurality of preset values and meter button can provide refrigerant pressure status.

The system can include computer instructions in the process control unit to provide a listing of spare parts to the display for viewing by a user.

Turning now to the Figures, FIG. 1 depicts a perspective view of an installed heating, ventilation, and air conditioning (HVAC) system 6 usable with the method having an enclosure 10.

The HVAC system 6, which can be modular, can be installed at a positive pressure facility 7 for providing positive pressure to an interior of the positive pressure facility 7.

In one or more embodiments, the HVAC system 6 can be configured to maintain positive pressure in the interior of the positive pressure facility 7 ranging from about 0.05 water column in inches to about 0.25 water column in inches.

The enclosure 10 can be secured to an exterior 8 of the positive pressure facility 7. For example, the enclosure 10 can be bolted or otherwise affixed to a portion of the exterior 8.

The enclosure 10 can include a base 14. The base 14 can have a first base opening 24 and a second base opening 25, which can both be configured to receive prongs of a forklift, allowing the enclosure 10 to be easily transported and installed.

The enclosure 10 can include a condenser compartment 16, which can be mounted to the base 14.

The enclosure 10 can include one or more lifting eyes 142*a* and 142*b*. The lifting eyes 142*a* and 142*b* can be configured for lifting the enclosure 10 as a one piece unit, such as by using a crane.

The condenser compartment 16 can have an air inlet grill 21, which can cover a side of the condenser compartment 16.

The condenser compartment 16 can have a condenser coil 18 disposed behind the air inlet grill 21.

A fresh air intake section 90 can be formed in the enclosure 10. The fresh air intake section 90 can be configured to bring in fresh air 89 from outside of the enclosure 10 into an evaporator compartment of the HVAC system 6. In operation, the fresh air intake section 90 can bring in the fresh air 89 from outside of the enclosure 10 into the evaporator compartment.

The fresh air intake section 90 can have a filter holder 92 for supporting an air filter 94 over the fresh air intake section 90.

Figure 2:
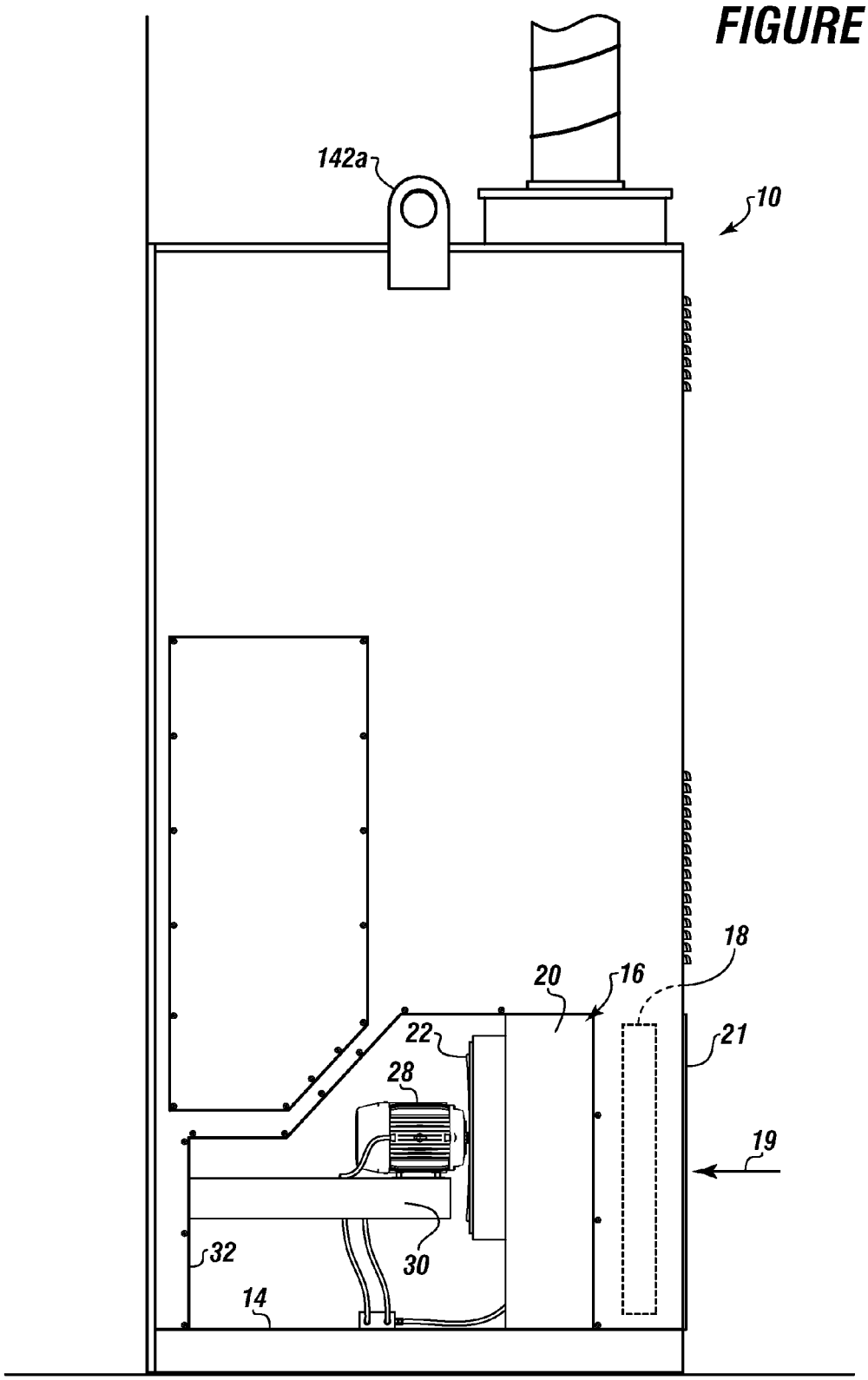
FIG. 2 depicts a detail of a condenser compartment of the HVAC system.

FIG. 2 depicts a side view of the enclosure 10 with the lifting eye 142*a* showing a detail view of an interior portion of the condenser compartment 16.

The condenser compartment 16 is shown mounted to the base 14, and can include an air venturi 20.

The air venturi 20 can be mounted to the condenser coil 18 opposite the air inlet grill 21.

The air venturi 20 can pull the surrounding air 19 through the air inlet grill 21 and across the condenser coil 18 to allow for easy viewing of particulate build up on the air inlet grill 21; thereby ensuring that maintenance and cleaning occurs as needed for proper air flow in the HVAC system.

The condenser compartment 16 can include a condenser motor 28 connected with an interior portion of a wall 32 of the condenser compartment 16. For example, a condenser motor bracket 30 can support the condenser motor 28 within the enclosure 10.

Fan blades 22 can be mounted to the condenser motor 28.

Figure 3:
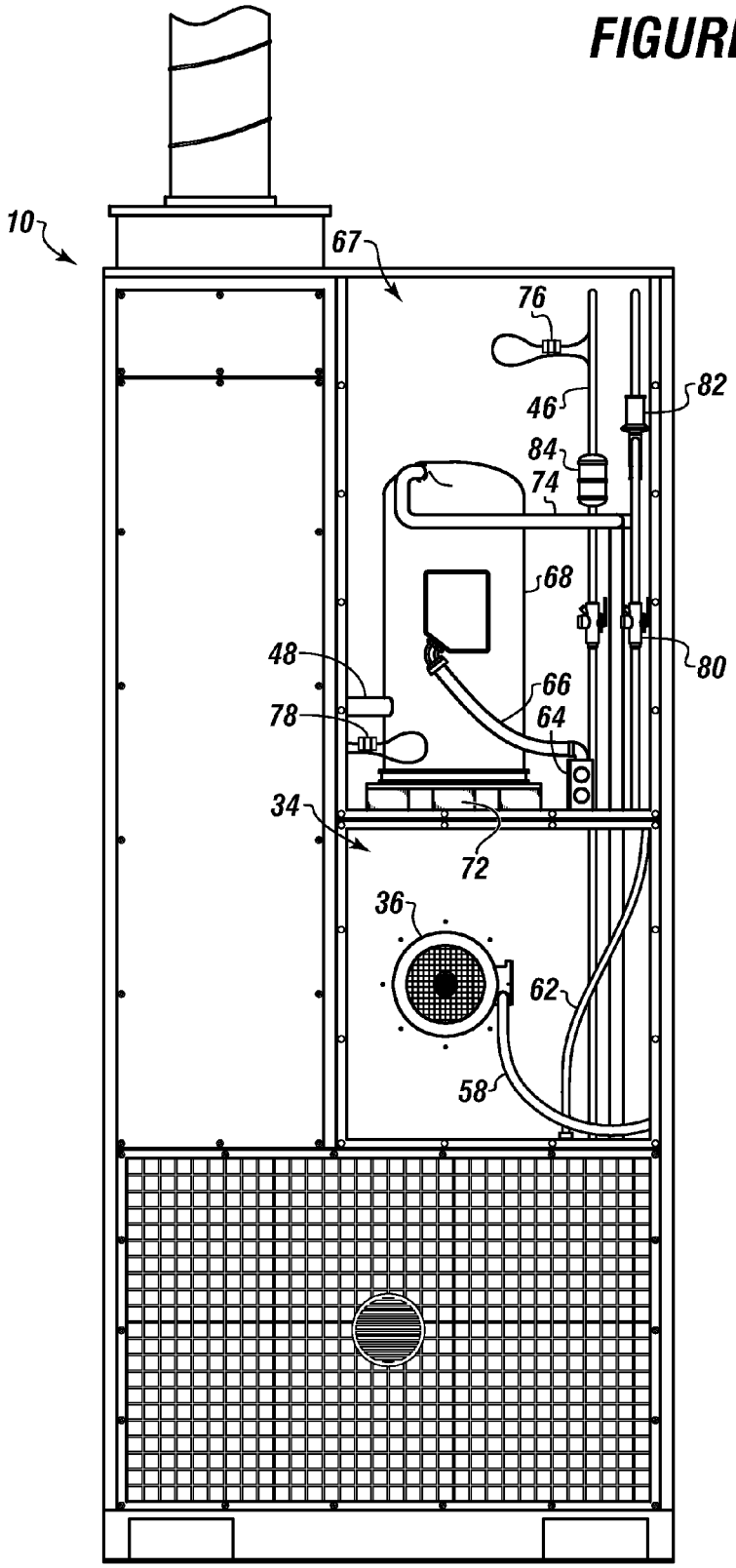
FIG. 3 depicts a detail of an evaporator motor compartment and compressor compartment.

FIG. 3 depicts the enclosure 10 showing a detailed view of a evaporator motor compartment 34 and a compressor compartment 67. The compressor compartment 67 can be connected with the evaporator motor compartment 34.

The evaporator motor compartment 34 can include at least one evaporator motor 36 mounted therein.

An evaporator flexible electrical conduit 58 can convey power through a junction box 64 from a power supply to the evaporator motor 36.

A condenser flexible electrical conduit 62 can convey power through the junction box 64 from the power supply to the condenser motor.

A compressor flexible electrical conduit 66 can convey power through the junction box 64 from the power supply to the compressor 68.

The compressor 68 can be mounted in the compressor compartment 67. For example, a compressor mount 72 in the compressor compartment 67 can support the compressor 68.

The compressor 68 can be connected between a refrigerant suction line 48 and a refrigerant discharge line 74.

A low pressure transducer 78 can be in communication with the refrigerant suction line 48.

A high pressure transducer 76 can be in communication with the refrigerant discharge line 74.

A shut off valve 80 can be in communication with the refrigerant suction line 48, and a hot gas bypass valve 82 can be in communication with the shut off valve 80.

A refrigerant site glass 84 can be in communication with a refrigerant liquid line 46.

Figure 4:
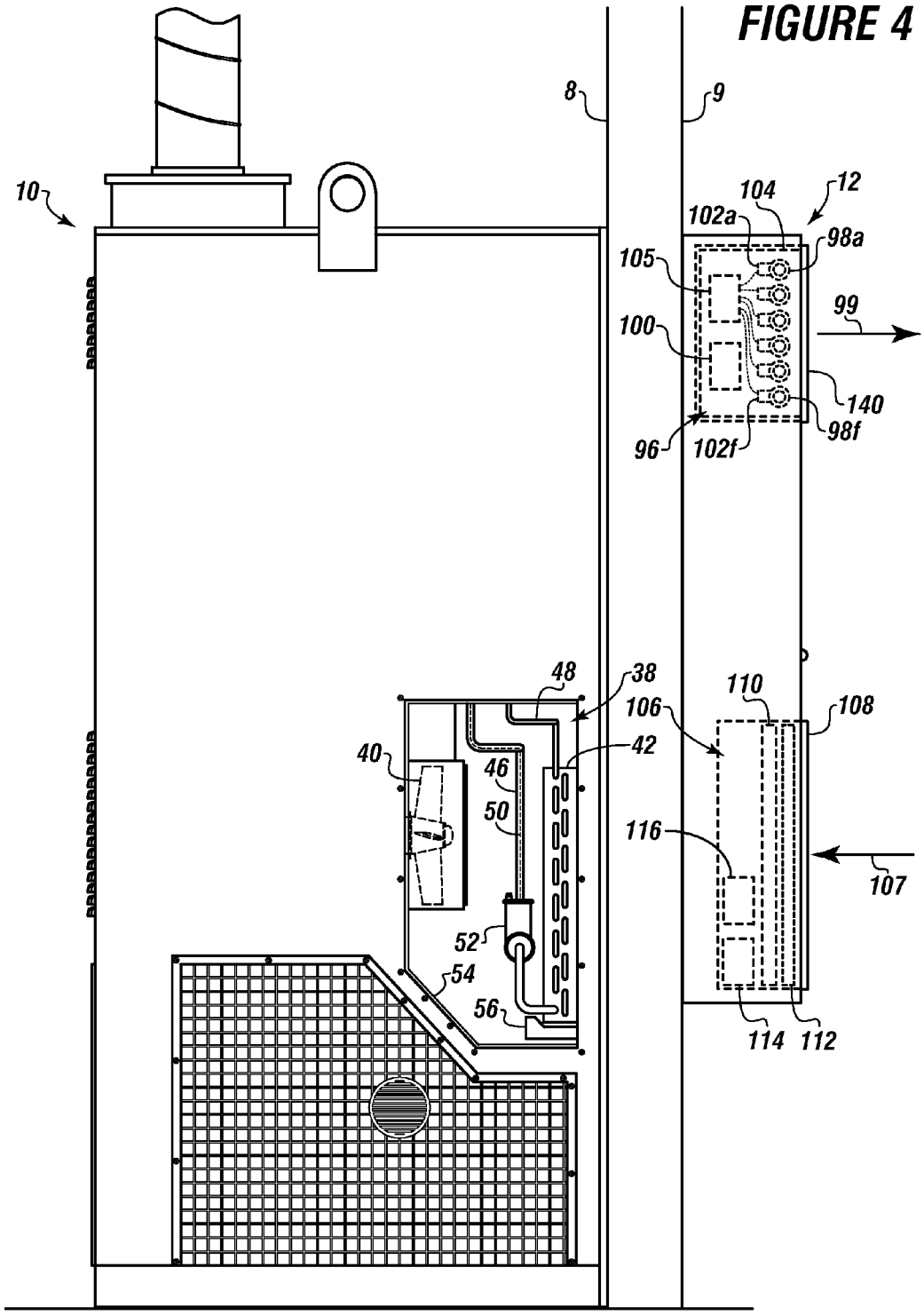
FIG. 4 depicts a detail of an evaporator compartment, a return air compartment, and a heater compartment.

FIG. 4 depicts the enclosure 10 showing a detail of the evaporator compartment 38, the heater compartment 96, and the return air compartment 106.

The enclosure 10 can be secured to the exterior 8 of the positive pressure facility, and the enclosure extension 12 can extend into the interior of the positive pressure facility.

The evaporator compartment 38 can include an evaporator fan 40, which can be connected with the evaporator motor.

The evaporator compartment 38 can include an evaporator coil 42 mounted therein. The evaporator coil 42 can be configured to receive a refrigerant through the refrigerant liquid line 46 to cool the fresh air and form a conditioned air.

A refrigerant 50 can then flow from the evaporator coil 42 through the refrigerant suction line 48.

The refrigerant liquid line 46 can be connected with the evaporator coil 42, and a thermostatic expansion valve 52 can be connected with the refrigerant liquid line 46. The refrigerant suction line 48 can also be connected with the evaporator coil 42.

Evaporator compartment insulation 54 can be affixed within the evaporator compartment 38.

The evaporator compartment 38 can include a drain 56, which can be configured to allow a condensate from the evaporator coil 42 to exit the evaporator compartment 38 via the drain 56.

The heater compartment 96 can be disposed adjacent a conditioned air grill 140. The conditioned air grill 140 can separate the heater compartment 96 from the interior 9 of the positive pressure facility.

The conditioned air 99 can flow from the enclosure extension 12 through the conditioned air grill 140.

The heater compartment 96 can include one or more fin heaters 98*a*-98*f*. Each fin heater 98*a*-98*f* can be connected with the power supply.

The heater compartment 96 can include a conditioned air temperature sensor 100 configured to monitor a temperature of the conditioned air 99 and transmit the monitored temperature to a process control unit.

The heater compartment 96 can include a plurality of resistive temperature detectors 102*a*-102*f*. Each resistive temperature detector 102*a*-102*f* can be connected with and monitor a temperature of one of the fin heaters 98*a*-98*f* for transmission to the process control unit.

Heater compartment insulation 104 can be mounted within the heater compartment 96.

A mechanical thermostat switch 105 can be connected with each of the fin heaters 98*a*-98*f* and in communication with the process control unit.

The return air compartment 106 can include a return air grill 108, a return air filter 110 mounted behind the return air grill 108. Return air 107 can flow through the return air grill 108 and return air filter 110.

In one or more embodiments, the return air 107 can be mixed with the fresh air to form the conditioned air 99. Also, a portion of the conditioned air 99 can be re-mixed with the fresh air to form additional conditioned air.

The return air compartment 106 can also include a plurality of opposed blade dampers 112, a humidistat 114 for measuring a humidity of the return air 107 for transmission to the process control unit, and a return air resistive temperature detector 116 for measuring a temperature of the return air 107 for transmission to the process control unit.

Figure 5:
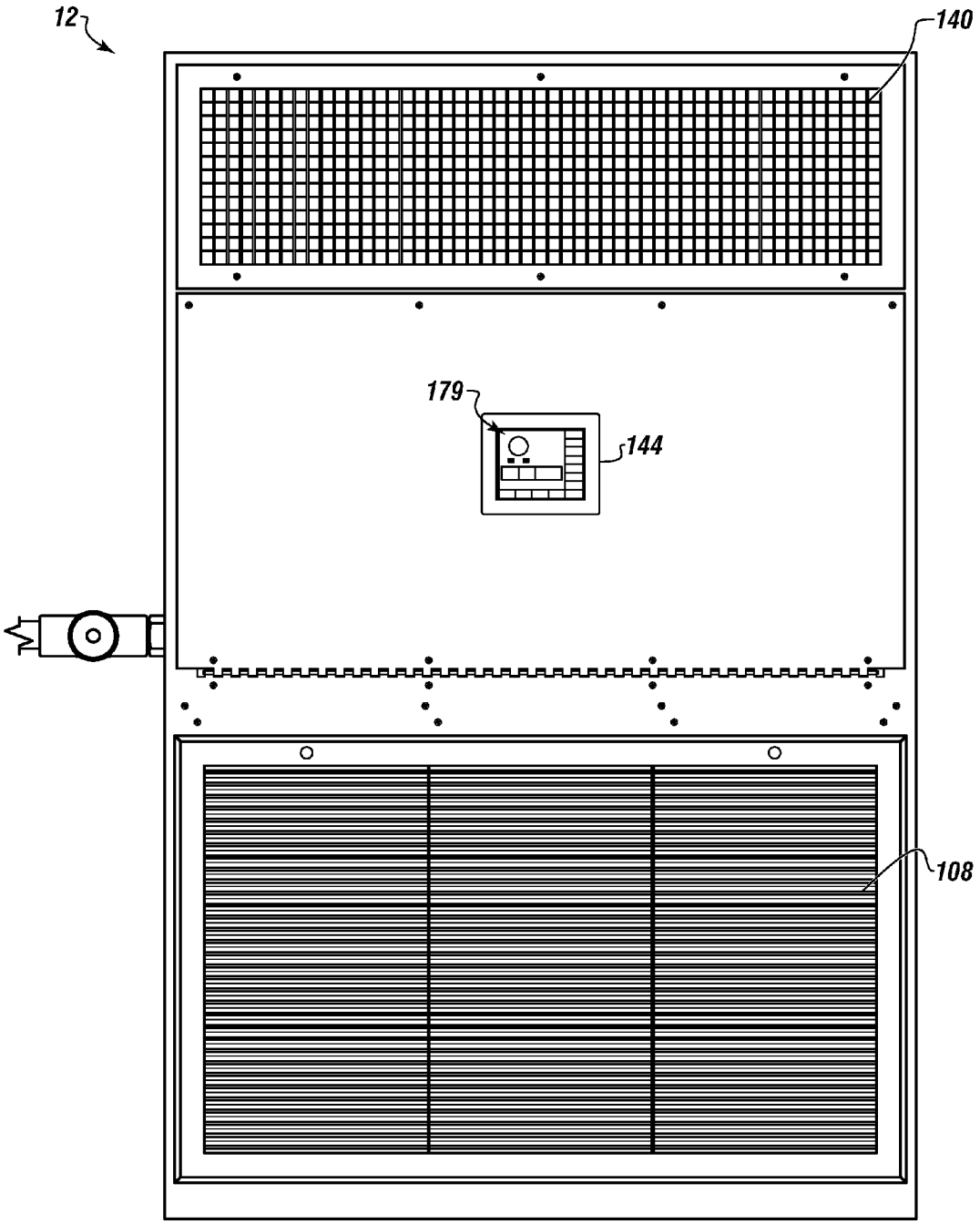
FIG. 5 depicts a view of an enclosure extension with a human machine interface.

FIG. 5 depicts a front view of an embodiment of the enclosure extension 12.

The enclosure extension 12 can protrude through the exterior and into the interior of the positive pressure facility, and can attach to the interior.

The conditioned air grill 140 can be disposed on the enclosure extension 12 for transmitting conditioned air into the interior.

The return air grill 108 can be disposed on the enclosure extension 12 receiving return air from the interior.

A human machine interface 144 having a display 179 can be disposed on the enclosure extension 12 for presenting real-time information to users in the interior, and for allowing the users to control one or more functions of the HVAC system.

The human machine interface 144 can be connected with or otherwise in communication with the process control unit for receiving data and information therefrom. The human machine interface 144 can be used to control the process control unit for controlling various portions of the HVAC system.

Figure 6:
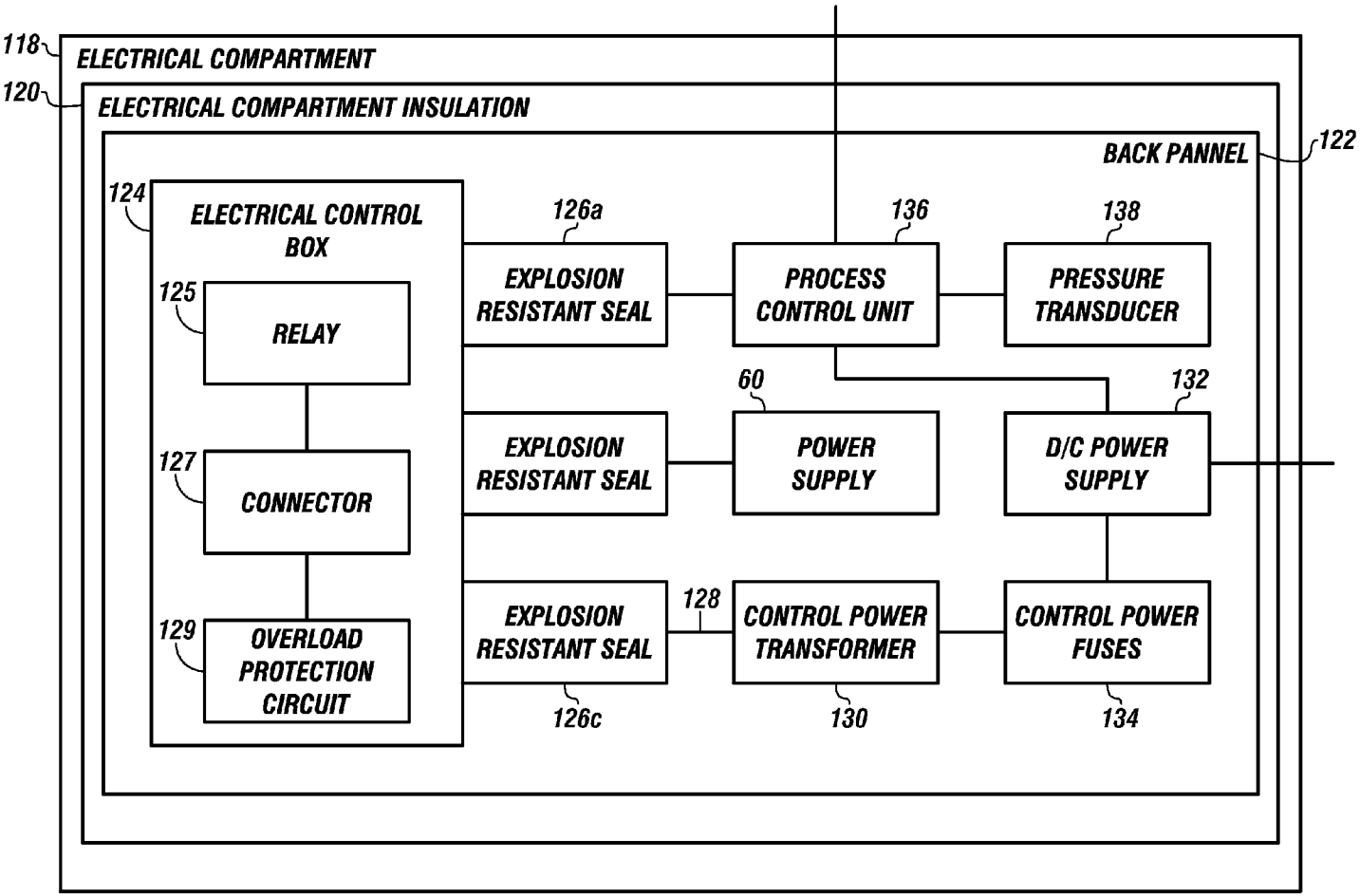
FIG. 6 depicts a diagram of an electrical compartment.

FIG. 6 depicts a detail of the electrical compartment 118, which can be connected with the return air compartment.

The electrical compartment 118 can include electrical compartment insulation 120 mounted therein.

The electrical compartment 118 can include an electrical control box 124, which can be configured to receive power from the power supply 60.

The electrical control box 124 can include a relay 125, a connector 127, and an overload protection circuit 129. The relay 125, connector 127, and overload protection circuit 129 can operate on the at least one evaporator motor, condenser motor, and compressor.

In one or more embodiments, the electrical compartment 118 can have a back panel 122, and the electrical control box 124 with the relay 125, connector 127, and overload protection circuit 129 can be mounted to the back panel 122.

The electrical compartment 118 can include a process control unit 136 connected with the electrical control box 124 for controlling electrical flow through the electrical compartment 118.

The electrical compartment 118 can include a pressure transducer 138 for determining a differential pressure between a pressure outside of the positive pressure facility and a pressure of the interior of the positive pressure facility. The pressure transducer 138 can be connected with the process control unit 136.

The electrical compartment 118 can include control wiring 128 to control power flow through the electrical control box 124, a control power transformer 130 connected with the control wiring 128, and a D/C power supply 132 connected with the control power transformer 130 through control power fuses 134.

In one or more embodiments, the electrical control box 124 can have a plurality of explosion resistant seals **126*a*-126*c* disposed on an outside surface of the electrical control box 124. The explosion resistant seals 126*a*-126*c* can be configured to surround inlet and outlet conduits connecting to the electrical control box 124**.

Figure 7:
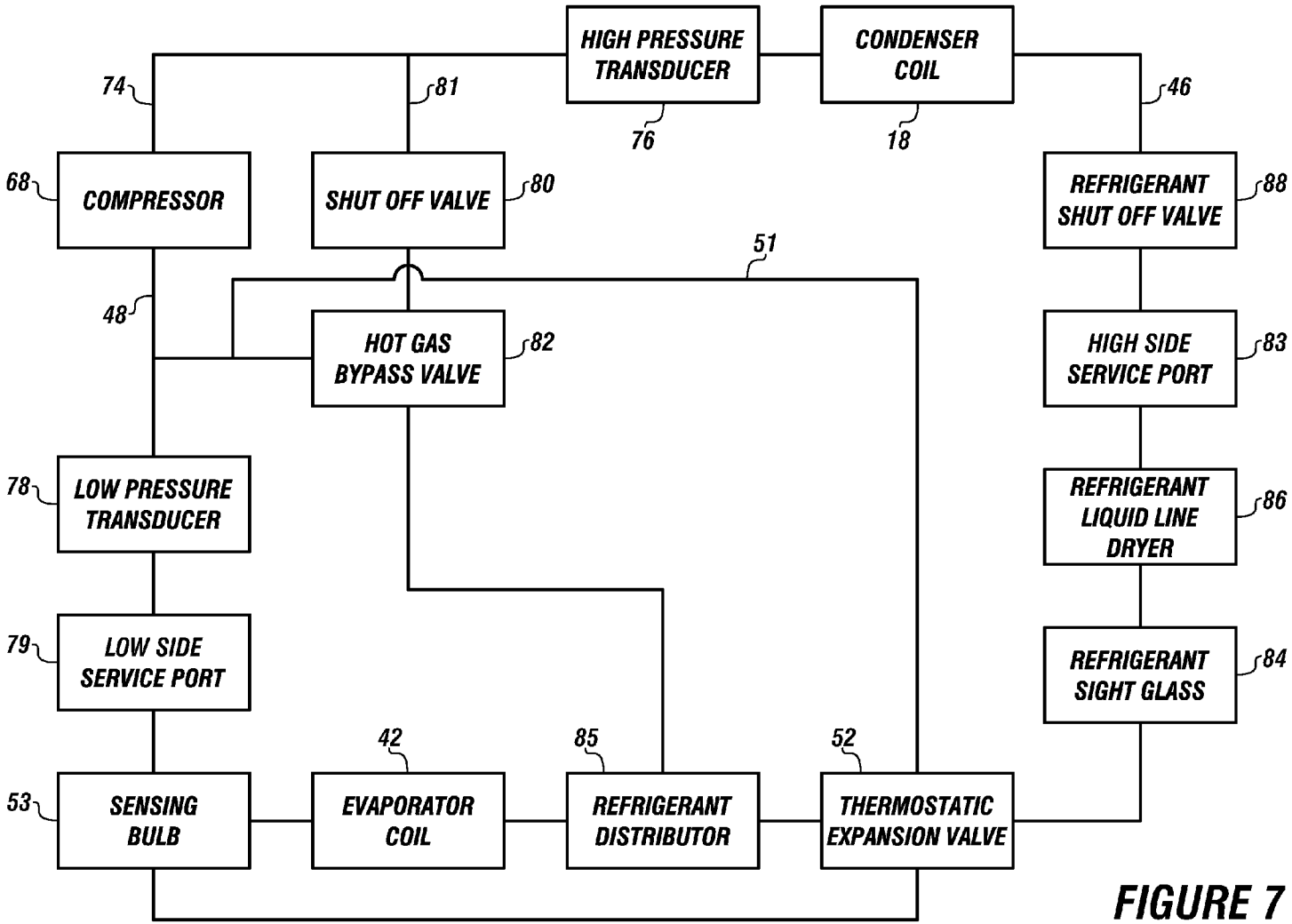
FIG. 7 depicts a diagram of refrigerant flow.

FIG. 7 depicts a diagram of refrigerant flow in the HVAC system.

The compressor 68 can be in communication with the condenser coil 18 through the refrigerant discharge line 74, and a high pressure transducer 76 can be disposed along the refrigerant discharge line 74 between the compressor 68 and condenser coil 18.

The compressor 68 can be in fluid communication with the evaporator coil 42 through a hot gas line 81. The hot gas line 81 can have a shut off valve 80 and a hot gas bypass valve 82.

Also, the compressor 68 can be in fluid communication with the evaporator coil 42 through the refrigerant suction line 48. The refrigerant suction line 48 can have a low pressure transducer 78, a low side service port 79, and a sensing bulb 53 disposed between the evaporator coil 42 and the compressor 68.

The condenser coil 18 can be in fluid communication with the evaporator coil 42 through the refrigerant liquid line 46.

The refrigerant liquid line 46 can have a refrigerant shut off valve 88 and a refrigerant liquid line dryer 86.

A high side service port 83 can be disposed between the refrigerant liquid line dryer 86 and the refrigerant shut off valve 88 in the refrigerant liquid line 46.

The refrigerant sight glass 84 can be disposed between the refrigerant liquid line dryer 86 and a thermostatic expansion valve 52.

In one or more embodiments, the refrigerant shut off valve 88 can be connected with the hot gas bypass valve 82.

A refrigerant distributer 85 can distribute refrigerant from the refrigerant liquid line 46 into the evaporator coil 42.

An equalizer tube 51 can engage with the hot bypass valve 82, refrigerant suction line 48, the thermostatic expansion valve 52, and the sensing bulb 53 on the refrigerant suction line 48.

Figure 8:
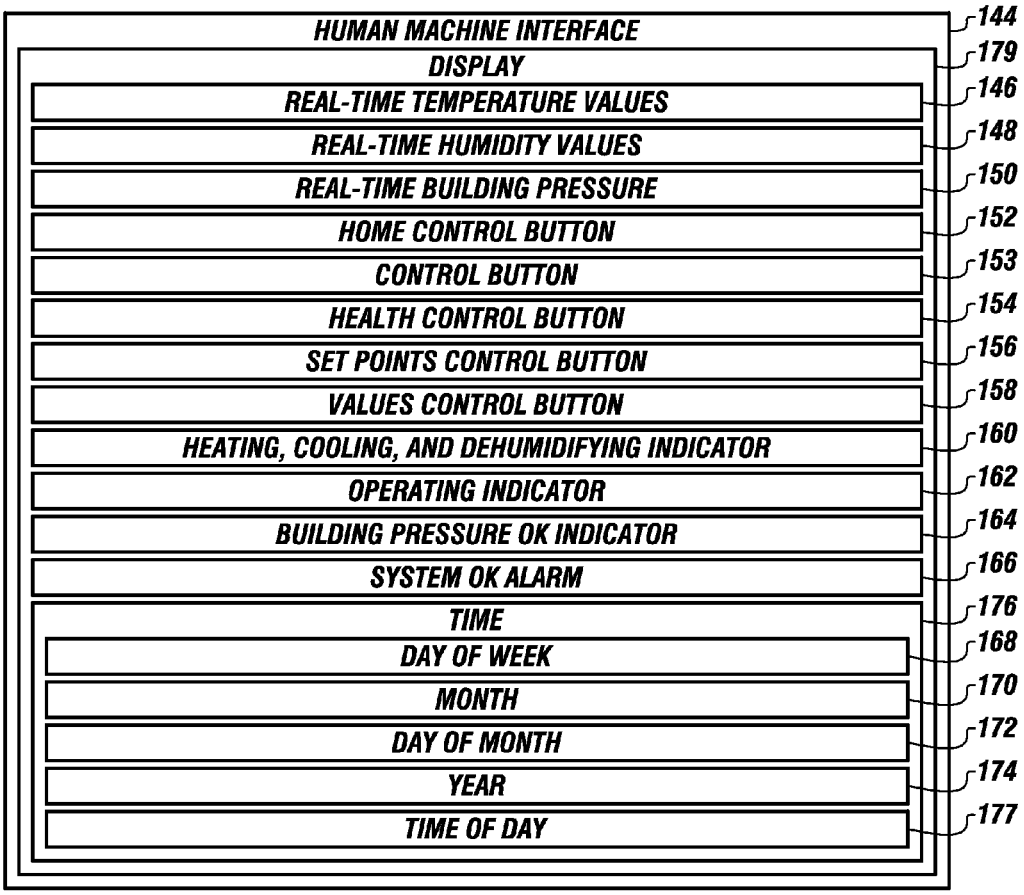
FIG. 8 depicts a home display screen of the human machine interface.

FIG. 8 depicts an embodiment of the human machine interface 144 having a display 179 presenting a home display screen for monitoring the HVAC system.

The display 179 can be configured to present: real-time temperature values 146, real-time humidity values 148, and a real-time building pressure 150, which can be reported in inches of a water column.

The display 179 can be configured to present: a home control button 152, a control button 153, a health control button 154, a set points control button 156, a values control button 158, and a heating, cooling, and dehumidifying indicator 160. The heating, cooling, and dehumidifying indicator 160 can be presented as a color, such as the color blue to represent cooling.

The display 179 can be configured to present an operating indicator 162, which can be presented as the color green to provide an online indication that system is operational.

The display 179 can be configured to present a building pressure OK indicator 164 and system OK alarm 166, which can both also be the color green or another color.

The display 179 can be configured to present time 176, which can include: a day of week 168, a month 170, a day of month 172, a year 174, and a time of day 177.

Figure 9:
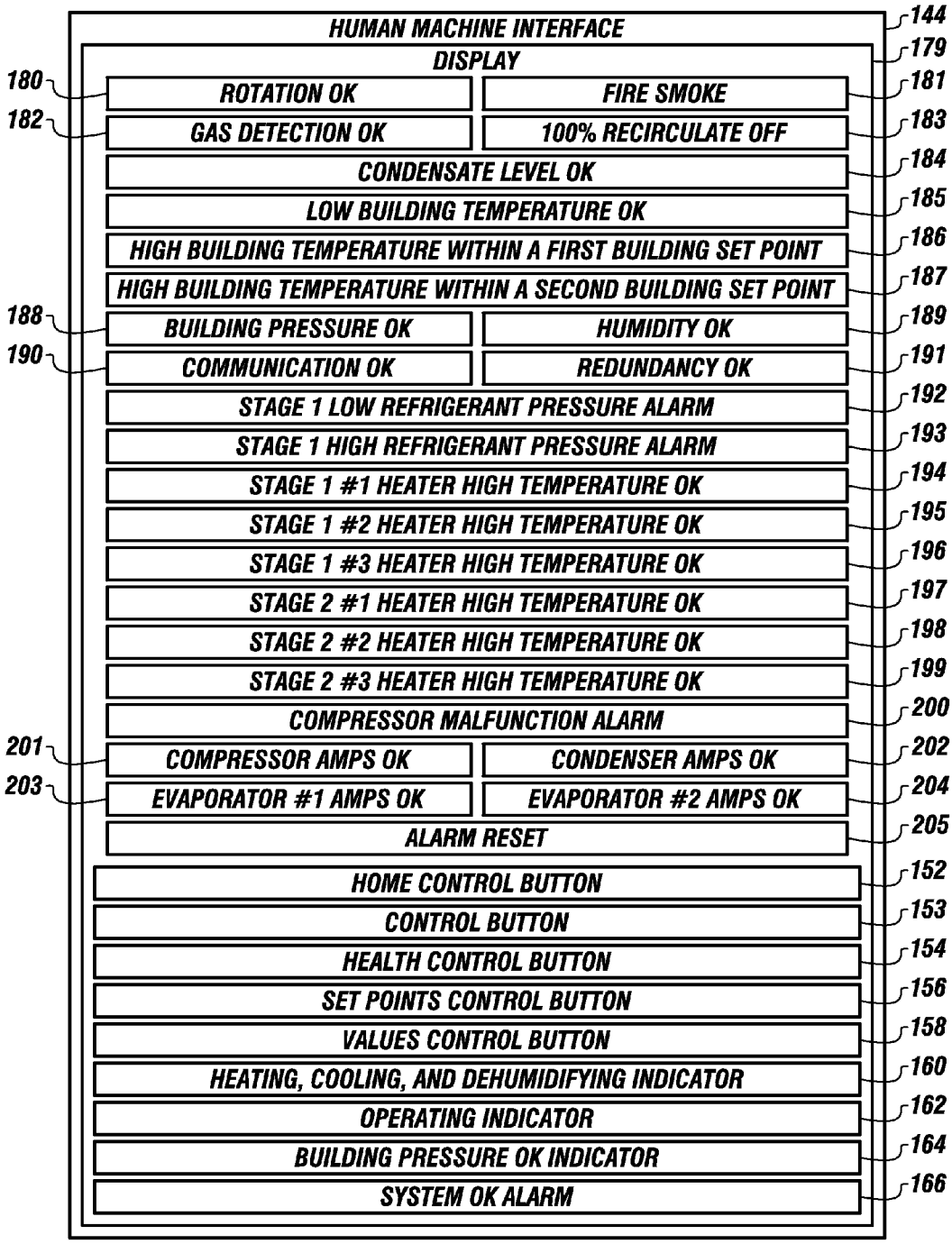
FIG. 9 depicts a health display screen of the human machine interface.

FIG. 9 depicts an embodiment of the human machine interface 144 with the display 179 showing a health display screen for monitoring the HVAC system.

Health screen computer instructions in the process control unit can cause real-time health information to be presented on the display 179. The health screen computer instructions can be linked to the health control button 154.

The real-time health information can be updated in one to five second intervals.

The real-time health information can include: rotation OK 180, fire smoke 181, gas detection OK 182, 100% recirculate off 183, condensate level OK 184, low building temperature OK 185, high building temperature within a first building set point 186, and high building temperature within a second building set point 187.

The real-time health information can include: building pressure OK 188, humidity OK 189, communication OK 190, redundancy OK 191, a stage 1 low refrigerant pressure alarm 192, a stage 1 high refrigerant pressure alarm 193, a stage 1 #1 heater high temperature OK 194, a stage 1 #2 heater high temperature OK 195, a stage 1 #3 heater high temperature OK 196, a stage 2 #1 heater high temperature OK 197, a stage 2 #2 heater high temperature OK 198, and a stage 2 #3 heater high temperature OK 199.

The real-time health information can include: a compressor malfunction alarm 200, compressor amps OK 201, condenser amps OK 202, evaporator #1 amps OK 203, an evaporator #2 amps OK 204, and an alarm reset 205.

The alarm reset 205, when initiated, can clear all alarms displayed on the display 179, and can reset all alarms that are inactive.

Along with the real-time health information, the display 179 can also present the home control button 152; the control button 153; the health control button 154; the set points control button 156; the values control button 158; the heating, cooling, and dehumidifying indicator 160; the operating indicator 162; the building pressure OK indicator 164; and the system OK alarm 166.

In operation, the health display screen on the display 179 can provide a visual aid to a user as to what caused an alarm to be initiated.

Figure 10:
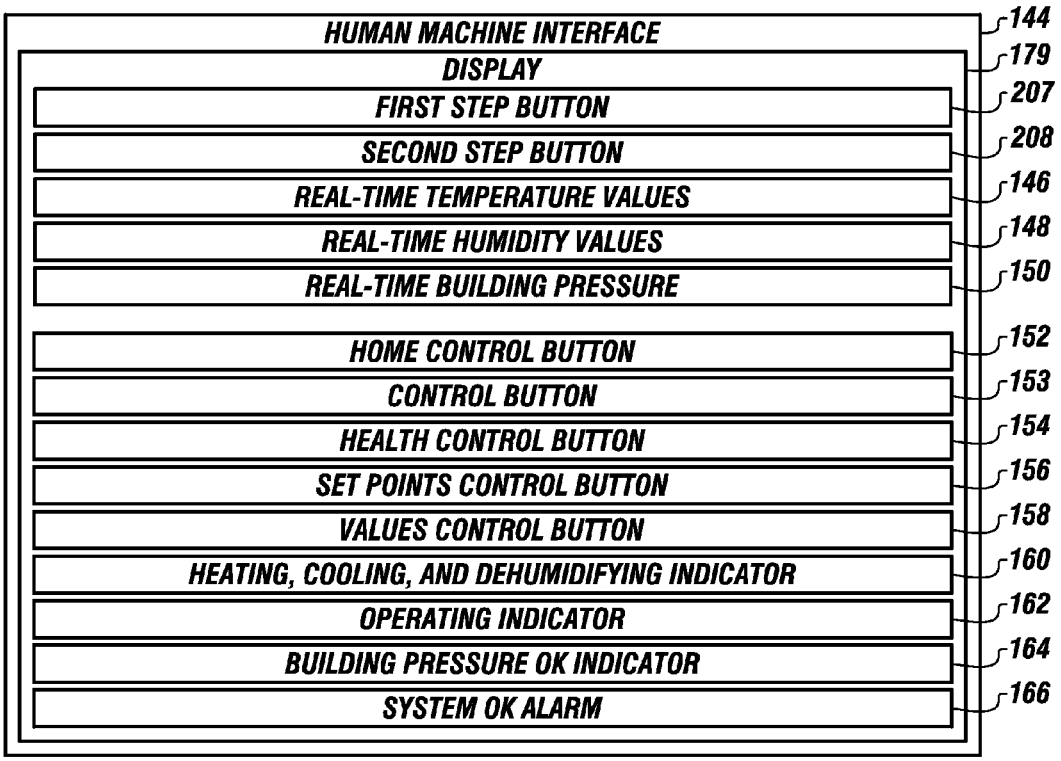
FIG. 10 depicts a control display screen of the human machine interface.

FIG. 10 depicts an embodiment of the human machine interface 144 with the display 179 showing a control display screen for monitoring the HVAC system.

Control screen computer instructions stored in the process control unit can cause real-time control information to be presented in the display 179. The control screen computer instructions can be linked to the control button 153.

The real-time control information can include: a first step button 207 for changing a status of the system from off, to auto, to on; a second step button 208 for changing the status of the system from on, to auto, to off; the real-time temperature values 146; the real-time humidity values 148; and the real-time building pressure 150 in water column inches.

In operation, the first step button 207 can be used to turn the HVAC system on or put the HVAC system into auto mode. When the HVAC system is turned on, rather than in auto mode, the HVAC system can operate in a non-redundant mode.

Along with the real-time control information, the display can also present the home control button 152; the control button 153; the health control button 154; the set points control button 156; the values control button 158; the heating, cooling, and dehumidifying indicator 160; the operating indicator 162; the building pressure OK indicator 164; and the system OK alarm 166.

Figure 11:
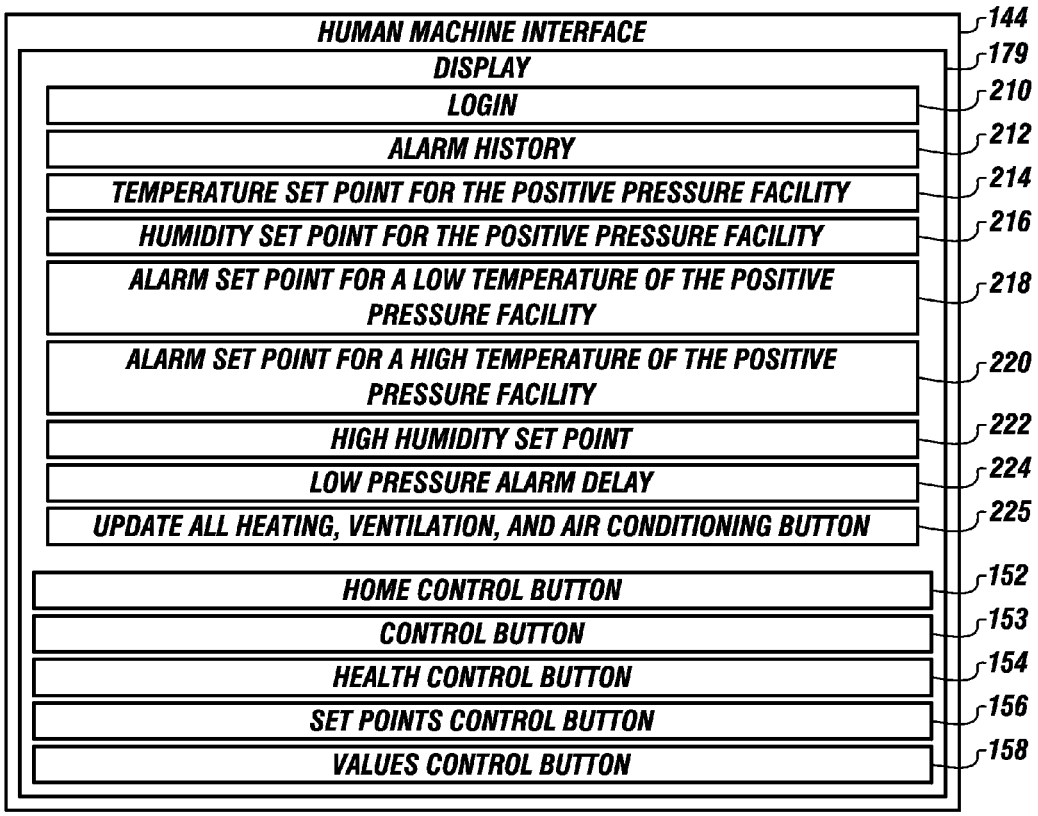
FIG. 11 depicts a set points display screen of the human machine interface.

FIG. 11 depicts an embodiment of the human machine interface 144 with the display 179 showing a set points display screen for monitoring the HVAC system.

Set points screen computer instructions in the process control unit can cause real-time set points information to be presented on the display 179. The set points screen computer instructions can be lined to the set points control button 156.

The real-time set points information can include: a login 210, an alarm history 212, a temperature set point for the positive pressure facility 214, a humidity set point for the positive pressure facility 216, an alarm set point for a low temperature of the positive pressure facility 218, an alarm set point for a high temperature of the positive pressure facility 220, a high humidity set point 222, and a low pressure alarm delay 224. The low pressure alarm delay 224 can be initiated when personnel enter or leave the positive pressure facility.

The real-time set points information can include an update all heating, ventilation, and air conditioning button 225, which can synchronize all connected set points with one stroke.

Along with the real-time set points information, the display 179 can present: the home control button 152, the control button 153, the health control button 154, the set points control button 156, and the values control button 158.

In operation, the set points display screen on the display 179 can be used to configure various levels of operation of the HVAC system. For example, the low and high temperatures, pressures, humidity levels, and the like at which alarms are initiated can be inputted using the set points display screen on the display 179. Also, the time can be set within the set points display screen on the display 179.

Figure 12:
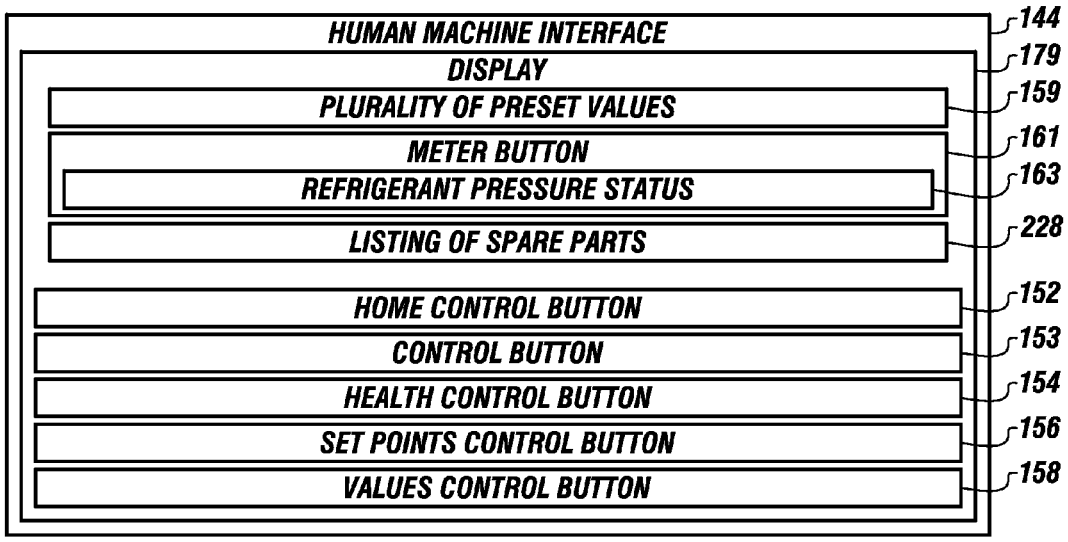
FIG. 12 depicts an embodiment of a real-time values screen of the human machine interface.

FIG. 12 depicts an embodiment of the human machine interface 144 with the display 179 showing a real-time values screen for monitoring the HVAC system.

Computer instructions in the process control unit, which can be linked to the values control button 158, can cause real-time values information to be presented on the display 179.

The real-time values information can include a plurality of preset values 159.

The plurality of preset values 159 can include the building pressure, the fan cycle, the amps being used by the system or portions of the system, measured temperatures of portions of the system, and measured temperatures and pressures of supply air, return air, ambient air, the refrigerant suction line, and the refrigerant liquid line.

The real-time values information can include a meter button 161. The meter button 161, when initiated, can provide a refrigerant pressure status 163.

The real-time values information can include a listing of spare parts 228.

Along with the real-time values information, the display 179 can present the home control button 152, control button 153, health control button 154, set points control button 156, and values control button 158.

In operation, the real-time values screen on the display 179 can present the current operating parameters of the HVAC system.

Figure 13:
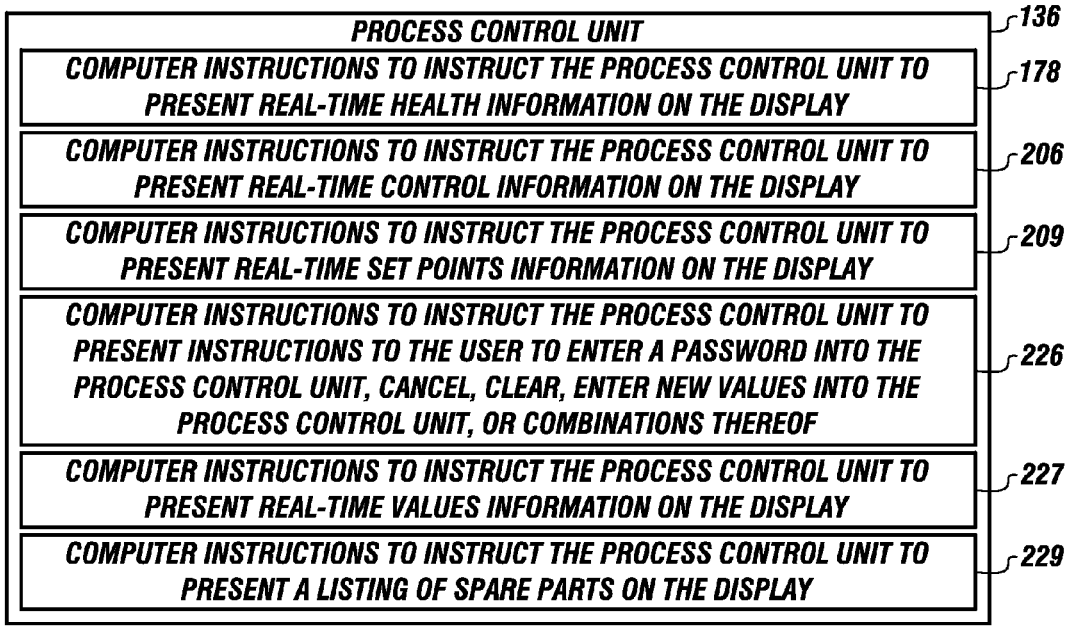
FIG. 13 depicts an embodiment of a process control unit.

FIG. 13 depicts an embodiment of the process control unit 136.

The process control unit 136 can have computer instructions to instruct the process control unit to present real-time health information on the display 178.

The process control unit 136 can have computer instructions to instruct the process control unit to present real-time control information on the display 206.

The process control unit 136 can have computer instructions to instruct the process control unit to present real-time set points information on the display 209.

The process control unit 136 can have computer instructions to instruct the process control unit to present instructions to the user to enter a password into the process control unit, cancel, clear, enter new values into the process control unit, or combinations thereof 226.

The process control unit 136 can have computer instructions to instruct the process control unit 136 to present real-time values information on the display 227.

The process control unit 136 can have computer instructions to instruct the process control unit to present a listing of spare parts on the display 229.

The real-time health information, real-time control information, real-time set points information, and real-time values information can each be updated in one to five second intervals.

Figure 14A:
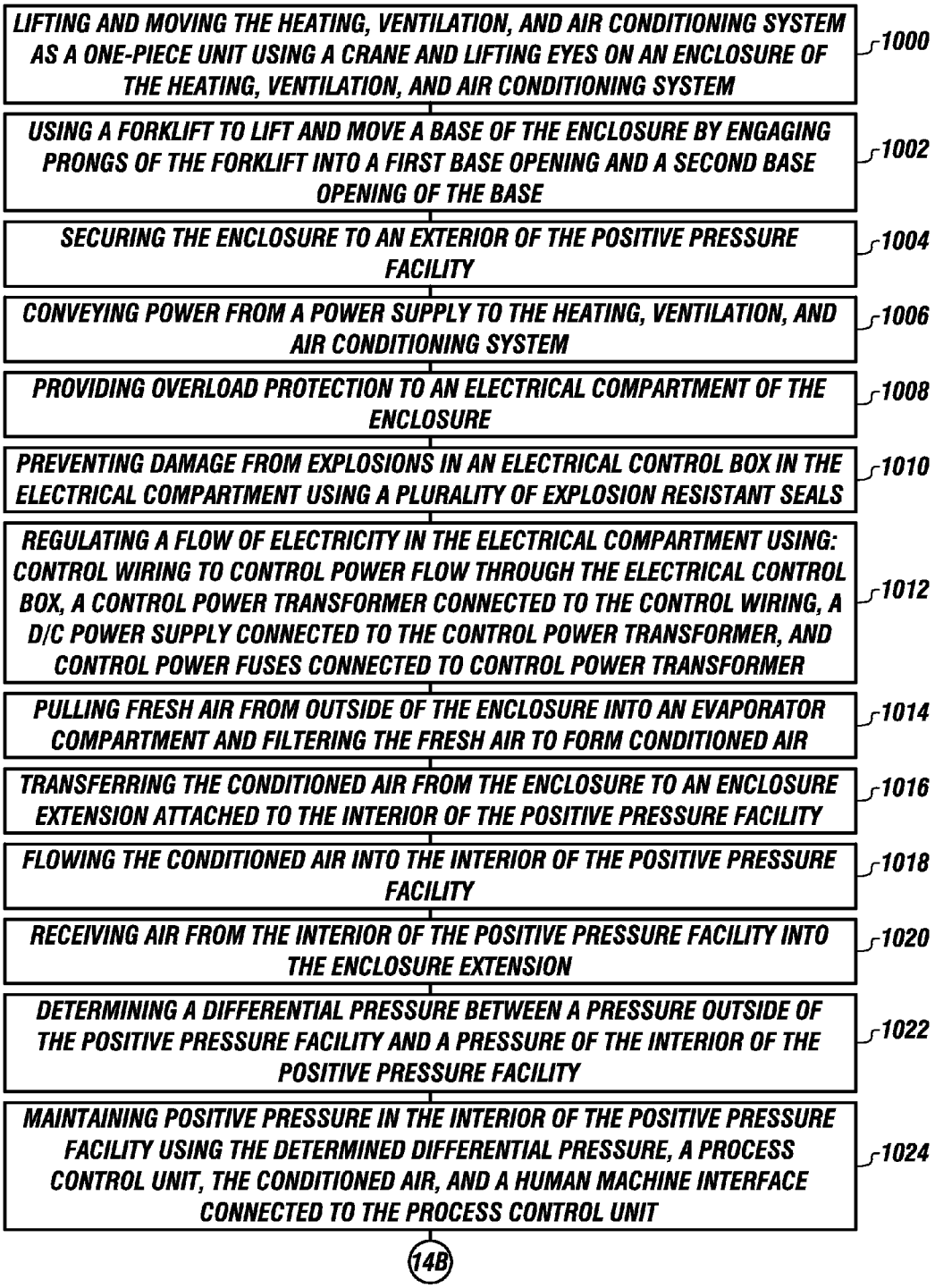
FIGS. 14A and 14B depict an embodiment of the method for providing positive pressure.
Figure 14B:
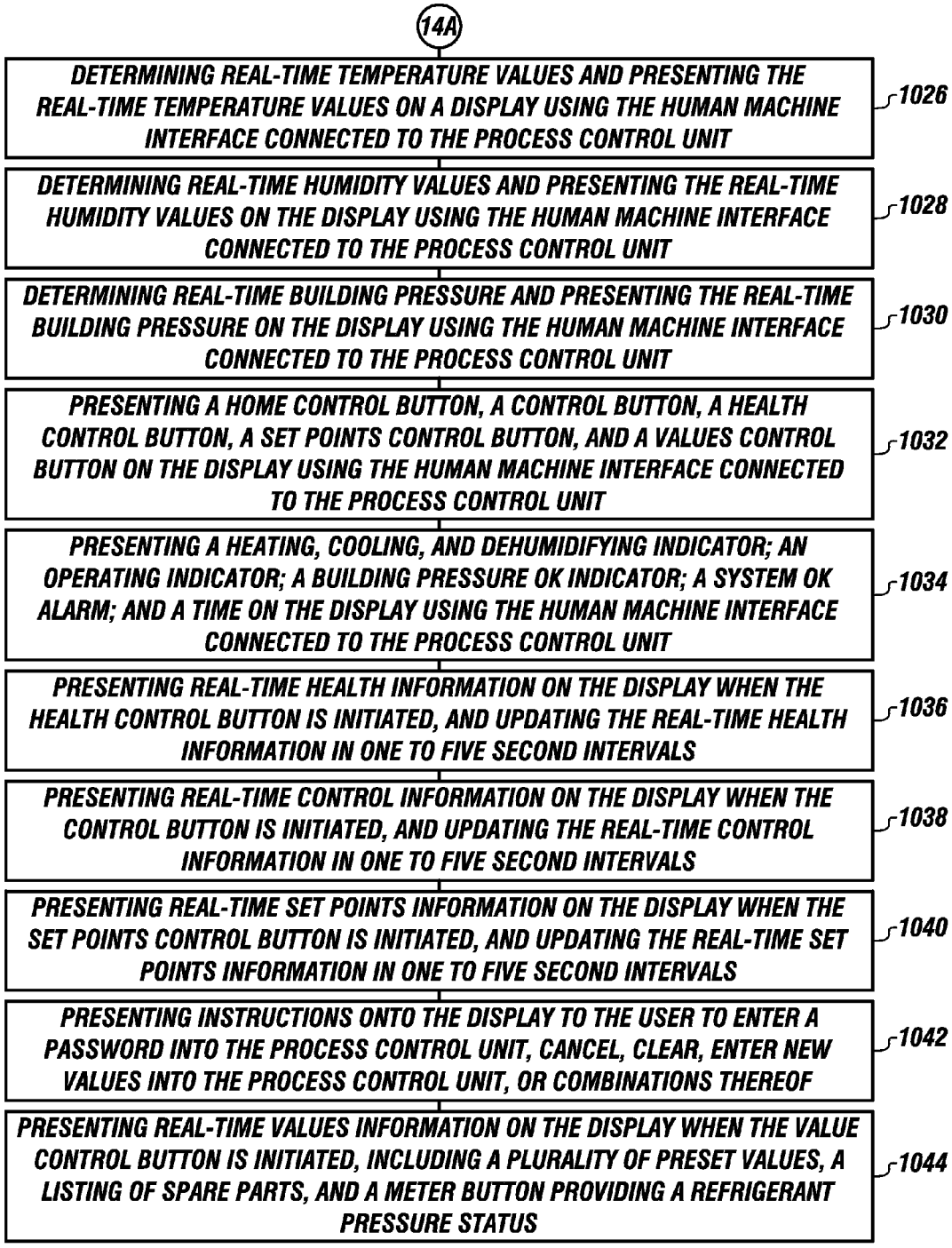

FIGS. 14A-14B depict an embodiment of a method for providing positive pressure to an interior of a positive pressure facility using a heating, ventilation, and air conditioning system.

The method can include lifting and moving the heating, ventilation, and air conditioning system as a one-piece unit using a crane and lifting eyes on an enclosure of the heating, ventilation, and air conditioning system, as illustrated by box 1000.

The method can include using a forklift to lift and move a base of the enclosure by engaging prongs of the forklift into a first base opening and a second base opening of the base, as illustrated by box 1002.

The method can include securing the enclosure to an exterior of the positive pressure facility, as illustrated by box 1004.

The method can include conveying power from a power supply to the heating, ventilation, and air conditioning system, as illustrated by box 1006.

The method can include providing overload protection to an electrical compartment of the enclosure, as illustrated by box 1008.

The method can include preventing damage from explosions in an electrical control box in the electrical compartment using a plurality of explosion resistant seals, as illustrated by box 1010.

The method can include regulating a flow of electricity in the electrical compartment using control wiring to control power flow through the electrical control box, a control power transformer connected with the control wiring, a D/C power supply connected with the control power transformer, and control power fuses connected with control power transformer, as illustrated by box 1012.

The method can include pulling fresh air from outside of the enclosure into an evaporator compartment and filtering the fresh air to form conditioned air, as illustrated by box 1014.

The method can include transferring the conditioned air from the enclosure to an enclosure extension attached to the interior of the positive pressure facility, as illustrated by box 1016.

The method can include flowing the conditioned air into the interior of the positive pressure facility, as illustrated by box 1018.

The method can include receiving air from the interior of the positive pressure facility into the enclosure extension, as illustrated by box 1020.

The method can include determining a differential pressure between a pressure outside of the positive pressure facility and a pressure of the interior of the positive pressure facility, as illustrated by box 1022.

The method can include maintaining positive pressure in the interior of the positive pressure facility using the determined differential pressure, a process control unit, the conditioned air, and a human machine interface connected with the process control unit, as illustrated by box 1024.

The method can include determining real-time temperature values and presenting the real-time temperature values on a display using the human machine interface connected with the process control unit, as illustrated by box 1026.

The method can include determining real-time humidity values and presenting the real-time humidity values on the display using the human machine interface connected with the process control unit, as illustrated by box 1028.

The method can include determining real-time building pressure and presenting the real-time building pressure on the display using the human machine interface connected with the process control unit, as illustrated by box 1030.

The method can include presenting a home control button, a control button, a health control button, a set points control button, and a values control button on the display using the human machine interface connected with the process control unit, as illustrated by box 1032.

The method can include presenting a heating, cooling, and dehumidifying indicator; an operating indicator; a building pressure OK indicator; a system OK alarm; and a time on the display using the human machine interface connected with the process control unit, as illustrated by box 1034.

The method can include presenting real-time health information on the display when the health control button is initiated, and updating the real-time health information in one to five second intervals, as illustrated by box 1036.

The method can include presenting real-time control information on the display when the control button is initiated, and updating the real-time control information in one to five second intervals, as illustrated by box 1038.

The method can include presenting real-time set points information on the display when the set points control button is initiated, and updating the real-time set points information in one to five second intervals, as illustrated by box 1040.

The method can include presenting instructions onto the display to the user to enter a password into the process control unit, cancel, clear, enter new values into the process control unit, or combinations thereof, as illustrated by box 1042.

The method can include presenting real-time values information on the display when the value control button is initiated, including a plurality of preset values, a listing of spare parts, and a meter button providing a refrigerant pressure status, as illustrated by box 1044.

While these embodiments have been described with emphasis on the embodiments, it should be understood that within the scope of the appended claims, the embodiments might be practiced other than as specifically described herein.

What is claimed is:

1. A modular heating, ventilation, and air conditioning system for providing positive pressure to an interior of a positive pressure facility, wherein the system comprises:

a. an enclosure for securing to an exterior of the positive pressure facility, wherein the enclosure comprises:

(i) a base;

(ii) a condenser compartment mounted to the base, wherein the condenser compartment has:

1. an air inlet grill covering a side of the condenser compartment; and
2. an air venturi mounted to a condenser coil in the condenser compartment, wherein the air venturi is configured to pull air through the air inlet grill and across the condenser coil using fan blades mounted to a condenser motor in the condenser compartment;

(iii) an evaporator motor compartment in the enclosure comprising at least one evaporator motor mounted therein;

(iv) an evaporator compartment in the enclosure comprising:

1. an evaporator fan connected with each evaporator motor;
2. an evaporator coil mounted in the evaporator compartment and configured to receive a refrigerant to cool fresh air and form conditioned air;
3. a refrigerant liquid line connected with the evaporator coil;
4. a refrigerant suction line connected with the evaporator coil;
5. a thermostatic expansion valve connected with the refrigerant liquid line; and
6. an evaporator compartment drain configured to allow a condensate from the evaporator coil to exit the evaporator compartment; and (v) a compressor compartment connected with the evaporator motor compartment, wherein the compressor compartment comprises:

1. a compressor mounted in the compressor compartment and connected between the refrigerant suction line and a refrigerant discharge line;
2. a high pressure transducer connected with the refrigerant discharge line;
3. a low pressure transducer connected with the refrigerant suction line;
4. a shut off valve connected with the refrigerant discharge line;
5. a hot gas bypass valve connected with the refrigerant suction line; and 6. a refrigerant shut off valve connected with the hot gas bypass valve;

b. a fresh air intake section formed in the enclosure and configured to draw in the fresh air from outside of the enclosure into the evaporator compartment;

c. a heater compartment in the enclosure comprising:

(i) at least two fin heaters connected with a power supply;

(ii) a conditioned air temperature sensor configured to monitor a temperature of the conditioned air; and (iii) a plurality of resistive temperature detectors, wherein each resistive temperature detector is connected with and monitors a temperature of one of the fin heaters; and d. an enclosure extension attached to the enclosure, wherein the enclosure extension is configured to protrude through the exterior and into the interior of the positive pressure facility, and wherein the enclosure extension comprises:

(i) a return air compartment comprising:

1. a plurality of opposed blade dampers;
2. a humidistat; and
3. a return air resistive temperature detector;

(ii) an electrical compartment connected with the return air compartment, wherein the electrical compartment comprises:

1. an electrical control box configured to receive power from the power supply, wherein the electrical control box comprises a relay, a connector, and an overload protection circuit for the at least one evaporator motor, the condenser motor, and the compressor;
2. a process control unit connected with the electrical control box for controlling electrical flow through the electrical compartment, wherein the process control unit is in communication with: the evaporator coil, the evaporator fan, the at least one evaporator motor, the condenser coil, the fan blades, the condenser motor, the compressor, the low pressure transducer, the high pressure transducer, the conditioned air temperature sensor, the plurality of resistive temperature detectors, and the return air resistive temperature detector; and
3. a pressure transducer for determining a differential pressure between a pressure outside of the positive pressure facility and a pressure of the interior of the positive pressure facility, wherein the pressure transducer is connected with the process control unit; and (iii) a human machine interface connected with the process control unit comprising a display configured to present:

1. real-time temperature values;
2. real-time humidity values;
3. real-time building pressure;
4. a home control button;
5. a control button;
6. a health control button;
7. a set points control button;
8. a values control button;
9. a heating, cooling, and dehumidifying indicator;
10. an operating indicator;
11. a building pressure OK indicator;
12. a system OK alarm; and
13. a time.

2. The system of claim 1, wherein the modular heating, ventilation, and air conditioning system is configured to maintain positive pressure in the interior of the positive pressure facility ranging from 0.05 water column inches to 0.25 water column inches.

3. The system of claim 1, further comprising:

a. a condenser motor bracket supporting the condenser motor in the enclosure;

b. a compressor mount in the compressor compartment supporting the compressor; or c. combinations thereof.

4. The system of claim 1, further comprising:

a. a first base opening and a second base opening in the base for receiving prongs of a forklift;

b. lifting eyes for lifting the enclosure as a one-piece unit with a crane; or c. combinations thereof.

5. The system of claim 1, further comprising:

a. an evaporator flexible electrical conduit for conveying power through a junction box from the power supply to the at least one evaporator motor;

b. a condenser flexible electrical conduit for conveying power through the junction box from the power supply to the condenser motor;

c. a compressor flexible electrical conduit for conveying power through the junction box from the power supply to the compressor; or d. combinations thereof.

6. The system of claim 1, wherein the fresh air intake has a filter holder supporting an air filter over the fresh air intake.

7. The system of claim 1, wherein the electrical compartment has a back panel, and wherein the relay, the connector, and the overload protection circuit are mounted to the back panel.

8. The system of claim 1, wherein the electrical control box further comprises a plurality of explosion resistant seals disposed on an outside surface of the electrical control box and configured to surround inlet and outlet conduits connecting to the electrical control box.

9. The system of claim 1, wherein the electrical compartment further comprises:

a. control wiring to control power flow through the electrical control box;

b. a control power transformer connected with the control wiring;

c. a D/C power supply connected with the control power transformer; and d. control power fuses connected with control power transformer.

10. The system of claim 1, further comprising computer instructions stored in the process control unit and linked to the health control button, wherein the computer instructions are configured to instruct the process control unit to present a health screen with real-time health information on the display, and wherein the screen displays information comprising:

a. rotation OK;

b. fire smoke;

c. gas detection OK;

d. 100 percent recirculate off;

e. condensate level OK;

f. low building temperature OK;

g. high building temperature within a first building set point;

h. high building temperature within a second building set point;

i. building pressure OK;

j. humidity OK;

k. communication OK;

l. redundancy OK;
m. stage 1 low refrigerant pressure alarm;
n. stage 2 high refrigerant pressure alarm;
o. stage 1 #1 heater high temperature OK;
p. stage 1 #2 heater high temperature OK;
q. stage 1 #3 heater high temperature OK;
r. stage 2 #1 heater high temperature OK;
s. stage 2 #2 heater high temperature OK;
t. stage 2 #3 heater high temperature OK;
u. a compressor malfunction alarm;
v. compressor amps OK;
w. condenser amps OK;
x. evaporator #1 amps OK;
y. evaporator #2 amps OK;
z. an alarm reset;
aa. the home control button;
bb. the control button;
cc. the health control button;
dd. the set points control button;
ee. the values control button;
ff. the heating, cooling, and dehumidifying indicator;
gg. the operating indicator;
hh. the building pressure OK indicator; and
ii. the system OK alarm.

11. The system of claim 1, further comprising computer instructions stored in the process control unit and linked to the control button, wherein the computer instructions are configured to instruct the process control unit to present a control screen with real-time control information on the display, wherein the screen displays information comprising:
a. a step button for changing a status of the modular heating, ventilation, and air conditioning system from off, to auto, to on;
b. the real-time temperature values;
c. the real-time humidity values;
d. the real-time building pressure;
e. the home control button;
f. the control button;
g. the health control button;
h. the set points control button;
i. the values control button;
j. the heating, cooling, and dehumidifying indicator;
k. the operating indicator;
l. the building pressure OK indicator; and
m. the system OK alarm.

12. The system of claim 1, further comprising computer instructions stored in the process control unit and linked to the set points control button, wherein the computer instructions are configured to instruct the process control unit to present a set points screen with real-time set points information on the display, wherein the screen displays information comprising:
a. a login;
b. an alarm history;
c. a temperature set point for the positive pressure facility;
d. a humidity set point for the positive pressure facility;
e. an alarm set point for a low temperature of the positive pressure facility;
f. an alarm set point for a high temperature of the positive pressure facility;
g. a high humidity set point;
h. a low pressure alarm delay, wherein the low pressure alarm delay is initiated when personnel enter or leave the positive pressure facility;
i. an update all heating, ventilation, and air conditioning button;
j. the home control button;
k. the control button;
l. the health control button;
m. the set points control button; and
n. the values control button.

13. The system of claim 12, further comprising computer instructions stored in the process control unit and configured to instruct the process control unit to present instructions to the user to enter a password into the process control unit, cancel, clear, enter new values into the process control unit, or combinations thereof.

14. The system of claim 1, further comprising computer instructions stored in the process control unit and configured to instruct the process control unit to provide to the display:
a. a plurality of preset values;
b. a listing of spare parts;
c. a meter button configured to provide a refrigerant pressure status; or
d. combinations thereof.

15. The system of claim 1, wherein the condenser compartment further comprises: an air inlet grill covering a side of the condenser compartment, wherein the condenser motor is connected with a wall of the condenser compartment.

16. The system of claim 1, wherein the evaporator compartment further comprises and evaporator compartment insulation affixed within the evaporator compartment.

17. The system of claim 1, wherein the compressor compartment further comprises:
a. a refrigerant site glass connected with the refrigerant liquid line; and
b. a refrigerant liquid line dryer connected with the refrigerant site glass.

18. The system of claim 1, wherein the return air compartment further comprises a return air grill and a return air filter.

19. The system of claim 1, wherein the electrical compartment further comprises electrical compartment insulation mounted therein and a conditioned air grill separating the heater compartment from the interior of the positive pressure facility.

20. The system of claim 1, wherein the time comprises a day of week, a month, a day of month, a year, and a time of day.

* * * * *